US005180650A

United States Patent [19]

Sacripante et al.

[11] Patent Number: 5,180,650

[45] Date of Patent: Jan. 19, 1993

[54] TONER COMPOSITIONS WITH CONDUCTIVE COLORED MAGNETIC PARTICLES

[75] Inventors: Guerino G. Sacripante, Oakville; Richard P. N. Veregin, Mississauga, both of Canada

[73] Assignee: Xerox Corporation, Stamford, Conn.

[21] Appl. No.: 828,620

[22] Filed: Jan. 31, 1992

[51] Int. Cl.[5] ..... G03G 9/083

[52] U.S. Cl. ..... 430/106.6; 430/137; 427/419.2; 427/437

[58] Field of Search ..... 430/106.6, 106, 39, 430/137; 427/419.2, 437

[56] References Cited

U.S. PATENT DOCUMENTS 4,443,527 4/1984 Heikens et al. ..... 430/39
4,623,602 11/1986 Bakker et al. ..... 430/106
4,803,144 2/1989 Hosoi ..... 430/106.6
4,937,167 6/1990 Moffat et al. ..... 430/137
5,021,315 6/1991 Goldman ..... 430/106.6

*Primary Examiner*—John Goodrow
*Attorney, Agent, or Firm*—E. O. Palazzo

[57] ABSTRACT

A toner composition comprised of resin particles, pigments, and a colored highly conductive magnetic composition comprised of a core comprised of a metal, and thereover a coating comprised of a lightly colored metal selected from the group consisting of copper, silver, cobalt, tin, gold, manganese, titanium, magnesium, vanadium, chromium, zinc, cadmium, indium, rhodium, niobium, platinum and aluminum, and in contact with the lightly colored metal a top coating comprised of a substantially colorless metal halide.

37 Claims, No Drawings

TONER COMPOSITIONS WITH CONDUCTIVE COLORED MAGNETIC PARTICLES

BACKGROUND OF THE INVENTION

The present invention is generally directed to conductive magnetic compositions and process thereof, and more specifically the present invention is directed to lightly colored conductive magnetic compositions, process thereof, and processes for the preparation of colored toner compositions, and inductive magnetic developers. In one embodiment, the present invention is related to magnetic particles with an average volume diameter of from about 0.1 micron to about 25 microns and more preferably from about 0.5 micron to about 6 microns, comprised of a core comprised of a magnetic particle, coated thereover with a lightly colored metal. In another embodiment, the present invention is related to magnetic particles with an average particle diameter size of from about 0.1 micron to about 25 microns and more preferably from about 0.5 micron to about 6 microns as measured by a Coulter Counter, which particles are comprised of a core comprised of a magnetic particle coated thereover with a lightly colored metal and overcoated thereover with a colorless metal halide, or oxide. Toner compositions comprised of resin particles, and the aforementioned magnetic particles are also encompassed by the present invention. In another embodiment, the present invention is related to a process for the preparation of magnetic particles comprised of a metal coated with another metal of a lightness value of from about 0 to about 60 units and preferably from about 0 to 30 units as measured by the Match-Scan II colorspectrometer available from Vidan Corporation. Moreover, in another embodiment, the colored metal coating is a light orange, brown, red, blue, or yellow color and displays a chroma of from about 0 to 40 units and a hue of from about 0 to 40 units as measured by the Match-Scan II colorspectrometer available from Vidan Corporation. In another embodiment, the present invention is related to a process for the preparation of lightly colored conductive magnetic particles of from about 0.1 micron to about 25 microns and more preferably from about 0.5 micron to about 6 microns, comprised of a core comprised of a metal; thereover a coating of a lightly colored metal formed by an in situ electrodeless electrochemical oxidation-reduction reaction between the magnetic particle surface and a solution of a soluble metal salt of the lightly colored metal ion. In yet another embodiment, the present invention is related to a process of preparing lightly colored conductive magnetic particles comprised of a core comprised of a metal; thereover a coating of a lightly colored metal formed by an in situ electrodeless electrochemical oxidation-reduction reaction between the magnetic particle surface and a solution of a soluble metal salt of the lightly colored metal ion; and thereover an overcoating of metal halide or metal oxide formed by an insitu oxidation reaction between the magnetic particle surface with a halide such as lodine or oxide such as peroxide. In another embodiment, the present invention is related to a process for the preparation of conductive magnetic particles wherein the overcoating of metal halide displays a lightness values of from about 0 to about 60 units and preferably from about 0 to 43 units; a chroma of from about 0 to 40 units and a hue of from about 0 to 40 units as measured by the Match-Scan II colorspectrometer available from Vidan Corporation. In another embodiment, the present invention relates to conductive lightly colored magnetic particles with conductivities of from about 0.1 $(ohm\text{-}cm)^{-1}$ to about $10^{-4}$ $(ohm\text{-}cm)^{-1}$. Another embodiment of the present invention relates to the use of the aforementioned lightly colored conductive magnetic particles in inductive magnetic developer compositions useful for ionographic processes. Also, in another embodiment the present invention relates to the use of these lightly colored conductive magnetic particles in magnetic colored toner compositions useful for xerographic processes.

The primary functions of the magnetic core particle is to provide appropriate magnetic properties such as from about 30 to about 120 emu per gram and more preferably from about 60 emu per gram to about 100 emu per gram. The primary function of the lightly colored metallic overcoating layer is to provide the desired conductivity of from about $10^{-4}$ $(ohm\text{-}cm)^{-1}$ to about $10^{-8}$ $(ohm\text{-}cm)^{-1}$, and in particular, to provide a light color to the magnetic particle with lightness values of from about 0 to about 60 units and preferably from about 0 to 40 units and more perferably from about 0 to about 6 units as measured by the Match-Scan II colorspectrometer available from Vidan Corporation. Effective metallic overcoating of the magnetic particle enables magnetic particles of very low tinctorial strength, such as a chroma of from about 0 to 40 units and a hue of from about 0 to 40 units as measured by the Match-Scan II colorspectrometer available from Vidan Corporation, enabling in embodiments the incorporation of these magnetic particles into colored toner compositions with complete, or substantially complete passivation of the coloring perturbation of the magnetic material on the colored toner composition. Coating of the core metal particle would lead to substantially the same, or higher conductivity for the coated magnetic particles enabling in one embodiment the incorporation of these magnetic particles into colored toner compositions where conductivity of from about $10^{-4}$ $(ohm\text{-}cm)^{-1}$ to about $10^{-8}$ $(ohm\text{-}cm)^{-1}$ is important for use in electrographic technologies. The primary function of the metallic halide or oxide overcoating layer is to provide the desired high conductivity of from about 0.1 $(ohm\text{-}cm)^{-1}$ to about $10^{-4}$ $(ohm\text{-}cm)^{-1}$, and in particular, to provide a light color with lightness of from about 0 to about 60 units, chroma of about 0 to about 40 units, and hue of about 0 to about 40 units, and preferably a colorless magnetic particle with lightness, chroma and hue of 10 units as measured by the Match-Scan II spectrometer. Effective metallic halide or oxide overcoating of the magnetic composite particle comprised of a metal coated with the aforementioned lightly colored metal enables magnetic particles of low tinctorial strength enabling in one embodiment the incorporation of these magnetic particles into highly conductive colored toner compositions with conductivity of from about 0.1 $(ohm\text{-}cm)^{-}$to about $10^{-4}$ $(ohm\text{-}cm)^{-1}$, and particularly useful in known inductive ionographic imaging systems, and technologies.

For a number of ionographic and electrophotographic imaging methods for printing and copying applications, it is desirable that the toner particles contain a magnetic material. Typical magnetic materials with appropriate magnetic properties for use in the preparation of such toner particles include metal powders of iron, cobalt, and nickel, metal oxide powders of iron or chromium, and ferrite particles of particle size in the range of about 20 nanometers to about 10 microns. Many of these particles, however, exhibit relatively poor electrical conductivity, such as from about $10^{-7}$ ohm-cm to about $10^{-14}$ ohm-cm, resulting in poor developability or no developability when employed in electrophotographic devices. Relatively higher electrical conductivity of from about $10^{-4}$ (ohm-cm)$^{-1}$ to about $10^{-8}$ (ohm-cm)$^{-1}$ is required for toner applications involving single component electrophotographic development systems. Additionally, yet even higher electrical conductivity is required for inductive signal component developers of from about 0.1 (ohm-cm)$^{-1}$ to about $10^{-4}$ (ohm-cm)$^{-1}$ for some ionographic development systems. The poor conductivity of these magnetic materials can be overcome by addition of highly conductive carbon black or tin oxide as external additives. However, the presence of external additives on magnetic pigments of high tinctorial strengths do not adversely affect the color quality of the magnetic pigment, other than black, and are of inferior color quality. Furthermore, the use of external conductive additives may display poor conductivity stability in both ionographic or electrographic processes. Furthermore, when carbon black is employed, it can restrict the use of such developer compositions to the production of black images only, and cannot be satisfactorily applied to the production of color images. In addition, many of the magnetic materials that have the required magnetic properties and the desired particle size for colored developer compositions are also black or darkly colored with relatively high tinctorial strength. Thus, these magnetic materials usually cannot be applied to the production of colored images, in particular lightly colored images, such as red, orange, yellow, green and magenta. Neutral color or matched color or lightly colored magnetic particles with suitable magnetic properties of from about 60 to about 100 emu per gram, and with resistivity of from about 0.1 (ohm-cm)$^{-1}$ to about $10^{-4}$ (ohm-cm)$^{-1}$ are not believed to be known. The conductive lightly colored magnetic particle compositions of the present invention, in one specific embodiment, can be generated by a direct preparative process involving an in situ electrochemical reaction between the surface of a core metallic magnetic particle, and a solution of a soluble salt of a lightly colored metal to produce an adherent coating metallic layer on the magnetic particle surface. In one embodiment, the coated magnetic particles are highly conductive, lightly colored with low tinctorial strength, and have suitable conductivity to meet all the requirements of magnetic toner compositions for color magnetic single component electrophotographic devices. Additionally, in another specific embodiment, the aforementioned conductive lightly colored magnetic particle comprised of a magnetic particle coated with a lightly colored conductive metal can be generated by a direct preparative process involving an oxidation reaction between the metal coating with a halide, such as iodine or oxide such as peroxide, or produce an outer coating of metal halide or metal oxide layer on the particle composite surface. In another embodiment, the aforementioned overcoated magnetic particles are highly conductive, lightly colored with low tinctorial strength, and have suitable conductivity to meet all the requirements of an inductive magnetic compositions for colored single component ionographic devices. For example, in a specific embodiment of this invention, the lightly colored magnetic particle is prepared by suspending about 1 mole percent by weight of iron metal powder of from about 1 to about 4 microns in an aqueous media containing copper(II)(valence of 2)sulfate of from about 0.2 mole percent by weight and catalytic amounts of sulfuric acid, effecting a metal coating of copper onto the core iron particle via an oxidation reduction reaction at a temperature of from about 10° C. to about 30° C. This aforementioned iron-copper magnetic particle is thus comprised of a core comprised of iron metal bound to a coating of copper metal resulting in a reddish color displaying a magnetic saturation of from about 80 emu per gram to about 85 emu per gram, and conductivity of from about $10^{-5}$ (ohm-cm)$^{-1}$. Subsequently, in another specific embodiment, the aforementioned iron-copper metal particle is treated with about 0.1 mole percent of iodine effecting an oxidation reaction between the outer metal copper coating and resulting in an outer coating of copper iodide at a temperature of from about 10° C. to about 30° C. This aforementioned magnetic particle is thus comprised of a core comprised of iron metal bound to a coating of copper metal and bounded thereover an overcoating of copper iodide layer resulting in a light reddish color displaying a magnetic saturation of from about 80 emu per gram to about 85 emu per gram, and conductivity from about 0.1 (ohm-cm)$^{-1}$ to about $10^{-4}$ (ohm-cm)$^{-1}$. Colored prints with chroma values of less than 40 units are considered poor quality to those in the art. In prior art magnetic toner compositions, the use of suitable magnetic materials displaying magnetic saturations of from about 60 to about 100 emu per gram, as well as displaying undesired high lightness values of from about 60 to about 100 units mask the effect of the pigment lightness, chroma and hue properties when incorporated with resin and pigments to obtain toner composition. The masking effect of the magnetic particles leads to poor quality colored prints with lightness, chroma and hue values of less than 40 units. In order to obtain good quality colored prints, it is desirable to use magnetic composites displaying suitable magnetic saturation of from about 60 to about 100 emu per gram as well as low lightness values of from about 0 to about 60 units, such that when incorporated into toner compositions with resins and pigments does not affect or perturb the high lightness, chroma and hue properties of the pigments, hence, generating good color quality prints with high lightness, chroma and hue values greater than 40 units.

The magnetic particles of this invention, and the toners thereof possess many advantages as illustrated herein. For example many prior art magnetic particles are coated externally to reduce their tinctorial strengths, but are only held statically to the surface and are not physically bound. Furthermore, such composites when utilized in the preparation of magnetic toners or developers do not retain their coated morphology and the external additives are removed partially or substantially from the metal particle during the process of the toner preparation yielding dull magnetic colored toner images. The magnetic particles, or compositions of the present invention in embodiments possess lightly colored metal or metal halide coatings bound to the surface and retain this morphology with low lightness of from about 0 to about 60 units and low tinctorial strengths of chroma values of from about 0 to 40 units and hue values of from about 0 to 40 units, and which during the preparation of colored magnetic toner compositions do not interfere or perturb the pigment's high lightness, chroma and hue, permitting rendering good excellent quality with substantially no background deposits, colored prints with high lightness, chroma and hue values of from about 60 to about 100 units as measured with the Match-Scan II spectrometer available fron Vidan Corporation.

The toner compositions of the present invention can be selected for a variety of known reprographic imaging processes including electrophotographic, especially xerographic, and ionographic processes. In one embodiment, the toner compositions can be selected for pressure fixing processes wherein the image is fixed with pressure. Pressure fixing is common in ionographic processes in which latent images are generated on a dielectric receiver such as silicon carbide, reference U.S. Pat. No. 4,885,220 (D/87316), entitled Amorphous Silicon Carbide Electroreceptors, the disclosure of which is totally incorporated herein by reference. The latent images can then be toned with the relatively conductive toner of the present invention by inductive single component development, and transferred and fixed simultaneously (transfix) in one single step onto paper with pressure. Specifically, the toner compositions of the present invention can be selected for the commercial Delphax printers, such as the Delphax S9000 TM, S6000 TM, S4500 TM, S3000 TM, and Xerox Corporation printers such as the 4060 TM and 4075 TM wherein, for example, transfixing is utilized. In another embodiment, the toner compositions of the present invention can be utilized in xerographic imaging apparatuses wherein image toning and transfer are accomplished electrostatically, and transferred images are fixed in a separate step by means of a pressure roll with or without the assistance of thermal or photochemical energy fusing.

In copending U.S. patent applications U.S. Pat. No. 5,135,832 (D/90192), U.S. Ser. No. 609,316 (D/90192Q) and U.S. Ser. No. 636,136 (now abandoned) (D/90152), the disclosures of which are totally incorporated herein by reference, there are illustrated colored magnetic toners comprised of magnetic particles of high tinctorial strength based on iron, chromium, or nickel dispersed in a core resin and containing whitening agents, such as titanium oxide, as well as a colored pigment, and which core is encapsulated by a polyurea shell containing conductive colorless additives on the surface.

In U.S. Pat. No. 4,443,527, the disclosure of which is incorporated herein by reference, there are disclosed magnetic particles such as chromium, nickel, iron, or cobalt oxides to produce yellow, brown or reddish color toner composition containing a mixture of finely divided reflecting pigment such as titanium dioxide coated on the metal particle as an external additive and contacting the masked particle with a suitable dye or pigment composition, wherein the dye or pigment coats or becomes embedded in said masking layer and dispersed in a fusible binder resin. Note that the masking coated layer and colored pigment is not bound to the seed magnetic particle and wherein the magnetic dye composite is conductive. In U.S. Pat. No. 4,623,602, substantially the same approach is disclosed except that the masking layer and colored layer contain a yellow fluoresecent dye, and binders are used in which the dye fluoresces. In U.S. Pat. No. 5,021,315, the disclosure of which is totally incorporated herein by reference, there is illustrated a process for overcoating a finely dispersed metal oxide by an in situ process where the metal oxide is in the size range of 1 to about 50 microns. Magnetic oxide particles are coated by depositing a layer of finely divided submicron sized particles of copper oxide onto the surface of the core magnetic metal oxide particles, followed by a subsequent reduction of the deposited copper oxide on the surface of the magnetic particle to metallic copper, and wherein such composite displays a resistivity of from about $10^5$ to $10^7$ ohm-cm, or conductivity of from about $10^{-5}$ to $10^{-7}$ (ohm-cm)$^{-1}$. The processes of this patent enable, for example, red colored conductive magnetic particles suitable for colored toner compositions. However, only iron oxide is used as the seed magnetic particle and is of high tinctorial strength, and wherein the process involves the reduction of copper oxide to copper, and furthermore, conductivity of less than $10^{-5}$ (ohm-cm)$^{-1}$ cannot be obtained. The processes of the present invention in embodiments provides advantages over the prior art indicated in that, for example, there is provided a simple and direct electrochemical oxidation-reduction method to produce a metallic magnetic core particle coated with a conductive lightly colored metal layer, and that a subsequent in situ oxidation with a halide provides an overcoating of highly conductive particle of from about 0.1 to $10^{-4}$ (ohm-cm)$^{-1}$ and needed for use in specific inductive ionographic processes. Additionally, a lightness value of from about 0 to about 40 units needed in embodiments to obtain high color intensity prints can be achieved with the toners of the present invention.

The following United States patents are mentioned in a patentability search report for patent application U.S. Ser. No. 609,333 U.S. Pat. No. 5,135,832 (D/90192), the disclosure of which is totally incorporated herein by reference, relating to encapsulated toners, and entitled Colored Toner Compositions: 4,803,144, which discloses an encapsulated toner with a core containing as a magnetizable substance a magnetite, see Example 1, which is black in color, wherein on the outer surface of the shell there is provided a white electroconductive powder, preferably a metal oxide powder, such as zinc oxide, titanium oxide, tin oxide, silicon oxide, barium oxide and others, see column 3, line 59, to column 4; in column 8 it is indicated that the colorant can be carbon black, blue, yellow, and red; in column 14 it is indicated that the electroconductive toner was employed in a one component developing process with magnetic brush development, thus it is believed that the toner of this patent is substantially insulating; 4,937,167 which relates to controlling the electrical characteristics of encapsulated toners, see for example columns 7 and 8, wherein there is mentioned that the outer surface of the shell may contain optional surface additives 7, examples of which include fumed silicas, or fumed metal oxides onto the surfaces of which have been deposited charge additives, see column 17 for example; 4,734,350 which discloses an improved positively charged toner with modified charge additives comprised of flow aid compositions having chemically bonded thereto, or chemically adsorbed on the surface certain amino alcohol derivatives, see the Abstract for example; the disclosures of each of the aforementioned patents being totally incorporated herein by reference; and which according to the search report are not significant but may be of some background interest 2,986,521; 4,051,077; 4,108,653; 4,301,228; 4,301,228; 4,626,487; 3,590,000; 3,983,045; 4,035,310; 4,298,672; 4,338,390; 4,560,635; 4,952,477; 4,939,061; 4,937,157; 4,904,762 and 4,883,736, the disclosures of each of these patents being totally incorporated herein by reference.

There is a need for lightly colored conductive magnetic particles, and in particular lightly colored conductive magnetic particles for the preparation of colored magnetic toner compositions with many of the advantages illustrated herein. There is a need for conductive magnetic particles with high magnetic saturation strengths of from about 30 emu per gram to about 120 emu per gram and more preferably from about 60 emu per gram to about 100 emu per gram. Additionally, there is a need for conductive magnetic particles which display conductivity of from about $10^{-4}$ (ohm-cm)$^{-1}$ to about $10^{-8}$ (ohm-cm)$^{-1}$, particularly in xerographic process, and from about 0.1 (ohm-cm)$^{-1}$ to about $10^{-4}$ (ohm-cm)$^{-1}$, particularly in ionographic process. Furthermore, there is a need for lightly colored magnetic conductive particles with lightness value of from about 0 to about 60 units and preferably from about 0 to about 40 units measured by the Match-Scan II spectrometer available from Vidan Corporation. Moreover, there is a need for lightly colored magnetic particles which display low tinctorial strength of chroma such as from about 0 to about 40 units and hue from about 0 to about 40 units, and preferably may be colorless, such that the chroma, lightness and hue values are about 0 units. Moreover, there is a need for brightly colored magnetic toner compositions displaying bright red, orange, cyan, magenta and yellow color which contain resin pigments and the aforementioned lightly colored and low tinctorial strength conductive magnetic particles. Additionally, there is a need for lightly colored magnetic conductive particles with a diameter size of from about 0.5 micron to about 25 microns and more preferably from about 0.1 micron to about 6 microns as measured by the Coulter Counter. Another associated need resides in the provision of preparative processes for obtaining lightly colored conductive magnetic particles, which possess a particle size diameter of 0.5 micron to about 25 microns, a magnetic saturation strength of from about 30 emu per gram to about 120, and a conductivity of from about $10^{-4}$ (ohm-cm)$^{-1}$ to about $10^{-8}$ (ohm-cm)$^{-1}$.

SUMMARY OF THE INVENTION

It is a feature of the present invention to provide a process for the preparation of lightly colored conductive magnetic particles with many of the advantages illustrated herein.

In another feature of the present invention there are provided processes for formation of magnetic particles bounded with a lightly colored metallic coating layer of low tinctorial strength.

In another feature of the present invention there are provided processes for the formation of magnetic particles bounded with a lightly colored metallic coating layer bounded thereover with an overcoated metal halide or oxide layer of low tinctorial strength.

In another feature of the present invention there are provided processes for formation of conductive magnetic particles bounded with a lightly colored metallic coating layer.

In another feature of the present invention there are provided processes for formation of magnetic particles bounded with a lightly colored metallic coating layer containing thereover an overcoated metal halide or oxide layer of high conductivity.

It is still another feature of the present invention to provide lightly colored conductive magnetic particles suitable for incorporation in colored toner compositions.

It is still another feature of the present invention to provide lightly colored conductive magnetic particles with magnetic properties suitable for incorporation in color toner compositions utilized in single component magnetic development in electrophotographic devices.

It is still another feature of the present invention to provide lightly colored conductive magnetic particles with high conductivity properties suitable for incorporation in colored developers utilized in single component inductive development in ionographic devices.

Also, an additional feature of the present invention resides in the provision of lightly colored conductive magnetic particles, colorants such as colored pigments or dyes with a wide spectrum of colors such as red, blue, green, brown, yellow, magenta, cyan, and mixtures thereof, for incorporation in toner compositions wherein the light coloration of the magnetic particles does not interfere substantially with the color of the dye or pigment.

In another feature of the present invention there are provided toner and developer compositions.

These and other features of the present invention can be accomplished by the provision of magnetic core particles coated with a lightly colored metallic coating layer, and more specifically by the provision of processes involving an electrodeless electrochemical oxidation-reduction reaction of the surface of the core magnetic particles. In one embodiment of the present invention, there are provided processes in which a metallic magnetic particle is dispersed in a solution of a soluble salt of a metal cation in a suitable solvent, such that the metallic magnetic core particle undergoes a spontaneous electrochemical oxidation reaction at the particle surface, wherein the metal is oxidized to the corresponding metal cation, while the soluble metal cation in solution undergoes a spontaneous electrochemical reduction reaction at the particle surface to form a metallic surface corresponding to the reduction of the soluble metal cation.

In embodiments of the present invention, there are provided toner compositions comprised of resin particles and a colored highly conductive magnetic composition comprised of a core comprised of a metal, thereover a coating comprised of a lightly colored metal such as copper, tin, aluminum, manganese, cobalt or silver and a top coating comprised of a substantially colorless metal halide such as copper iodide or oxide such as tin oxide, aluminum oxide or titanium oxide.

One embodiment of the present invention is directed to a toner composition comprised of resin particles and a colored highly conductive magnetic composition comprised of a core comprised of a metal, and thereover a coating comprised of a lightly colored metal selected from the group consisting of copper, silver, cobalt, tin, gold, manganese, titanium, magnesium, vanadium, chromium, zinc, cadmium, indium, rhodium, niobium, platinum and aluminum, and in contact with the lightly colored metal a top coating comprised of a substantially colorless metal halide selected from the group consisting of copper iodide, copper bromide, copper chloride, magnesium iodide, cobalt iodide, silver iodide, vanadium chloride, chromium chloride, and platinum chloride.

In an embodiment of the present invention, there is provided a toner component comprised of coating of magnetic core particles with a lightly colored metallic layer, which core is prepared by a process involving an electrodeless electrochemical oxidation-reduction reaction of the surface of the core magnetic particles, and thereover, overcoated with a colorless or lightly colored metal halide. In one embodiment of the present invention, there are provided processes in which a metallic magnetic particle is dispersed in a solution of a soluble salt of a metal cation in a suitable solvent, such that the metallic magnetic core particle undergoes a spontaneous electrochemical oxidation reaction at the particle surface, wherein the metal is oxidized to the corresponding metal cation, while the soluble metal cation in solution undergoes a spontaneous electrochemical reduction reaction at the particle surface to form a metallic surface corresponding to the reduction of the soluble metal cation; subsequently followed by oxidizing partially or all of the lightly colored metal coating with a halide or peroxide yielding a metal halide or oxide overcoating.

In embodiments of the present invention, there are provided processes where the magnetic core particle has a particle size diameter of from about 0.5 micron to about 25 microns, and preferably from about 1 micron to about 6 microns as measured by the Coulter Counter, and wherein the magnetic core particle is selected from the group consisting of metals where the saturation magnetic moment of the magnetic particles is between about 30 to about 120 emu per gram, and preferably between about 60 to about 100 emu per gram, and wherein the conductivity of the lightly colored conductive magnetic particles are from about 0.1 $(ohm\text{-}cm)^{-1}$ to about $10^{-8}(ohm\text{-}cm)^{-1}$, the lightness of the colored metal coating and metal halide or oxide overcoating is from about 0 to about 60 units, and the tinctorial strengths of the magnetic particles are of chroma and hue of from about 0 to about 40 units.

In an embodiment, the lightly colored conductive magnetic particle comprised of a core comprised of an iron metal and coated thereover with a copper metal can be prepared by (i) suspending about 1.0 mole percent to about 1.2 mole percent by weight of iron powder (commercially available as SICOPUR 4068FF TM, average particle diameter of 4 microns) in about 0.5 to about one liter of water; (ii) adding a catalytic amount of sulfuric acid of from about 0.0001 mole percent to about 0.01 mole percent; (iii) followed by a slow addition of the soluble metal cation salt of from about 0.05 mole percent to about 0.3 mole percent by weight such as copper(II)sulfate over a period of 1 minutes to about 10 minutes, thus effecting a spontaneous oxidation-reduction reaction at a temperature of from about 10° C. to about 30° C., and optionally cooling this exotherm reaction such that the bath temperature is maintained from about 10° C. to about 60° C.; (iv) followed by filtration of the lightly colored magnetic particle, washing with water and isolation by air dry filtration, spray drying or fluid bed dring process.

In another embodiment, the lightly colored conductive magnetic particle comprised of a core comprised of an iron metal and coated thereover with a copper metal, and overcoated thereover with a copper iodide layer can be prepared by (i) suspending about 1.0 mole percent to about 1.2 mole percent by weight of iron powder (commercially available as SICOPUR 4068FF TM, average particle diameter of 4 microns) in about 0.5 to about one liter of water; (ii) adding a catalytic amount of sulfuric acid of from about 0.0001 mole percent to about 0.01 mole percent; (iii) followed by a slow addition of from about one minute to about 20 minutes of the soluble metal cation salt of from about 0.05 mole percent to about 0.3 mole percent by weight such as copper(II)sulfate over a period of about 1 minute to about 10 minutes, thus effecting a spontaneous oxidation-reduction reaction at a temperature of from about 10° C. to about 30° C., and optionally cooling this exotherm reaction with ice-water bath such that the bath temperature is maintained from about 10° C. to about 60° C.; (iv) followed by filtration by vacuum suction of the lightly colored magnetic particle, washing with water and resuspending the particles in about 0.5 liter to about one liter of water; (v) followed by the addition of from about 0.025 mole percent to about 0.2 mole percent of iodine, thus effecting the oxidation of the copper coating to copper iodide at a temperature of from about 10° C. to about 30° C.; (vi) followed by filtration of the lightly colored magnetic particle, washing with an aqueous solution of from about 0.1 to about 5 percent by weight of water and sodium thiosulfate and followed by washing with water, and isolation by air dry filtration, spray drying or fluid bed drying process.

Illustrative examples of magnetic core particles that can be selected for the present invention include iron powder, such as those derived from the reduction of iron tetracarbonyl, and commercially available from BASF as SICOPUR 4068 FF TM; cobalt powder, commercially available from Noah Chemical Company; METGLAS TM and ultrafine METGLAS TM, commercially available from Allied Company; treated iron oxides such as BAYFERROX AC5106M TM, commercially available from Mobay; treated iron oxide TMB-50 TM, commercially available from Magnox; CARBONYLIRON SF TM, commercially available from GAF Company; MAPICO TAN TM, commercially available from Columbia Company; treated iron oxide MO-2230 TM, commercially available from Pfizer Company; nickel powder ONF 2460 TM, commercially available from Sherritt Gordon Canada Company; nickel powder; chromium powder; manganese ferrites; and the like. The preferred average diameter particle size of the magnetic material is from about 0.05 micron to about 25 microns, although other particle sizes may also be utilized.

In embodiments of the present invention, there are provided processes where the electrochemical reduction potential of the soluble coating metal cation salt in the solution is more positive by about $10^{-2}$ volts to about 10 volts or more than the electrochemical reduction potential of the core magnetic metallic particle to be coated, such that the overall electrochemical potential of the reduction of the soluble metal ion in solution combined with the oxidation of the metal surface of the core magnetic particle results in a spontaneous reaction. Illustrative examples of soluble metal salts in solvents, such as water or alcohol of from about 0.05 moles per liter to about 10 moles per liter, that can be selected include soluble metal salts containing the metal ions $Sn^{+2}$, $Pb^{+2}$, $Sn^{+4}$, $Cu^{+}$, $Cu^{+2}$, $Ag^{+}$, $Pt^{+2}$, $Au^{+}$, or the metal ion containing species $Cu_2Cl_3$ or $Hg_2Cl_2$. Preferred metal ions are those that are lightly colored in the metallic state, such as tin which is white in color, copper which is light red in color, silver which is white or silver in color, platinum which is white in color, or gold which is light yellow in color. Illustrative examples of suitable counterions or the soluble metal species include fluoride, chloride, bromide, iodide, sulfate, nitrate, acetate, thiocyanate, or cyanide, mixtures thereof, and the like.

Illustrative examples of suitable solvents that may be employed at a ratio of from about 1 to about 1,000 parts compared to the metal and metal ions, include water. Other suitable solvents that may be employed include aliphatic with, for example 1 to about 25 carbon atoms, alcohols such as methyl alcohol, ethyl alcohol, butyl alcohol, propyl alcohol, isopropyl alcohol, isobutyl alcohol, tertiary, decyl alcohol, amyl alcohol, and isoamyl alcohol. Other suitable solvents include, but are not limited to, acetone, dimethylformamide, tetrahydrofuran, ethyl acetate, dichloromethane, and chloroform.

Optional catalysts selected in effective amounts of, for example, from about 0.01 percent by weight to about 0.1 percent by weight of metal that may be employed include acids, such as for example hydrochloric acid, hydrofluoric acid, hydrobromic acid, hydroiodic acid, acetic acid, nitric acid, sulfuric acid, phosphoric acid, and boric acid. Other catalysts that may be employed include bases such as sodium hydroxide, potassium hydroxide, magnesium hydroxide, calcium hydroxide, aluminum hydroxide, sodium carbonate, and potassium carbonate. Additional catalysts that may be employed include soluble salts, including, but not limited to, salts containing fluoride, chloride, bromide, iodide, sulfate, nitrate, sulfate, acetate, tiocyanate, or cyanide counterions.

Illustrative examples of suitable halides or peroxides selected in effective amounts of, for example, from about 0.1 to about 30 percent by weight of metal to partially or fully oxidize the lightly colored metal coating to the metal halide or oxide overcoating that can be selected include iodine, chlorine, bromine, fluorine, hydrogen peroxide, di-t-butylperoxide, other organooxides known in the art, mixtures thereof and the like.

An illustrative specific example of lightly colored conductive magnetic material is comprised of 1 mole of metal, such as iron powder, coated with from about 0.1 mole to about 0.3 mole percent of metal coating such as copper, and thereover a coating with from about 0.1 to about 0.2 mole percent of a metal halide such as copper iodide.

Illustrative examples of suitable toner resins selected for the toner and developer compositions of the present invention, and present in various effective amounts such as, for example, from about 20 percent by weight to about 95 percent by weight, include polyesters, polyamides, polywaxes, ELVAX TM, VERSAMID TM, epoxy resins, polyurethanes, polyolefins, polyethylene oxide, vinyl resins and polymeric esterification products of a dicarboxylic acid and a diol comprising a diphenol, and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. Examples of specific toner resins include styrene butadiene copolymers, especially styrene butadiene copolymers prepared by a suspension polymerization process, reference U.S. Pat. No. 4,558,108, the disclosure of which is totally incorporated herein by reference; and mixtures thereof.

As one toner resin there can be selected the esterification products of a dicarboxylic acid and a diol comprising a diphenol, which components are illustrated in U.S. Pat. No. 3,590,000, the disclosure of which is totally incorporated herein by reference. Other preferred toner resins included styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES ® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol; polyesters such as those derived from isophthalic acid, fumaric acid and glycols such as SPARR II ® resins available from Ashley Chemicals Company; other resins comprise mixtures of polyethylene oxides such as ELVAX ® available from DuPont Corporation or POLYWAX ® available from Petrolite Chemicals Company, and polyamides such as VERSAMID ® available from Henkle Chemicals Company.

Illustrative examples of pigments that may be present in the toner composition in effective amounts, such as for example from about 1 to about 12 percent by weight, of toner include HELIOGEN BLUE TM, HOSTAPERM PINK TM, NOVAPERM YELLOW TM, LITHOL SCARLET TM, MICROLITH BROWN TM, SUDAN BLUE TM, FANAL PINK TM, PV FAST BLUE TM, mixtures thereof, known cyans, yellows and magentas, and the like.

Illustrative examples of optional charge enhancing additives present in the toner in various effective amounts, such as for example from about 0.1 to about 20 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like.

The following Examples are being submitted to further define various species of the present invention. These examples are intended to be illustrative only and are not intended to limit the scope of the present invention.

EXAMPLE I

Synthesis of a reddish conductive magnetic particle comprised of 80 percent by weight of iron and coated with 20 percent by weight of copper metal.

Iron powder (SICOPUR 4068FF TM, 500 grams, obtained from BASF) was suspended in water (4 liters) containing a catalytic amount of concentrated sulfuric acid (5 milliliters). To this suspension was then added slowly, over a five minute period, copper(II)sulfate (200 grams). The resulting solution was stirred for 1 hour, wherein the iron powder surface was oxidized to iron sulfate (soluble in water) and the copper(II)sulfate was reduced onto the seed iron powder metal to copper. The resultant reddish product was then filtered off by vacuum filtration, and washed with water and then air dried to yield the above reddish magnetic material (480 grams) comprised of iron core of about 80 percent by weight, and a lightly colored copper metal coating of about 20 percent by weight. The resulting red magnetic particles had a volume average particle diameter of 3.8 microns and a particle size distribution of 1.38 as determined by Coulter Counter measurements using Coulter Counter Model ZM, available from Coulter Electronics, Inc.

The saturation magnetic moment of the above product was then obtained by referencing its induced current per gram by using 10 grams of sample (above prepared reddish color particle product) to that of a 10 gram sample of nickel. For the magnetic particles of this Example, the saturation magnetic moment was 80 emu per gram. The conductivity was obtained by preparing a pressed pellet of the product at 2,000 pounds per square inch, and employing a standard conductivity meter device. For the magnetic particles of this Example, the conductivity was measured to be $4\times10^{-5}$ (ohm-cm)$^{-1}$. The red color of this magnetic material was stable even after 12 months of storage at room temperature, about 25° C. The color properties of the above prepared product were then measured using the Match-Scan II spectrometer available from Vidan Corporation, and for the prepared magnetic particles the lightness value was 32 units, the chroma was 10 units and the hue was 20 units.

EXAMPLE II

Synthesis of a reddish conductive magnetic particle comprised of 90 percent by weight of iron and coated with 10 percent by weight of copper metal:

Iron powder (SICOPUR 4068FF TM, 500 grams, obtained from BASF) is suspended in water (4 liters) containing a catalytic amount of sulfuric acid (5 milliliters). To this suspension is then added slowly copper(II)sulfate (100 grams) over a five minute period. The solution resulting was stirred for 1 hour, wherein the iron powder surface was oxidized to iron sulfate (soluble in water) and the copper(II)sulfate was reduced onto the seed iron powder metal to copper. The resultant reddish product was then filtered off by vacuum filtration and washed with water, and then air dried to yield the reddish magnetic material (490 grams) comprised of iron core of about 90 percent by weight, and a lightly colored copper coating of about 10 percent by weight. The resulting red magnetic particles had a volume average particle diameter of 3.6 microns and a particle size distribution of 1.38 as determined by Coulter Counter measurements using Coulter Counter Model ZM, available from Coulter Electronics, Inc.

The saturation magnetic moment was then obtained by referencing its induced current per gram by using 10 grams of sample product to that of a 10 gram sample of nickel. For the magnetic particles of this Example, the saturation magnetic moment was 90 emu per gram. The conductivity was obtained by preparing a pressed pellet of the product at 2,000 pounds per square inch using a press, and employing a standard conductivity meter device. For the magnetic particles of this Example, the conductivity was measured to be $1\times10^{-6}$ (ohm-cm)$^{-1}$. The color properties were then measured using the Match-Scan II spectrometer available from Vidan Corporation, and for the magnetic particles of this Example the lightness value was 38 units, the chroma was 19 units and the hue was 28 units. The lightness, chroma and hue properties of this magnetic material did not change even after 12 months of storage at room temperature, about 25° C.

EXAMPLE III

Synthesis of a reddish conductive magnetic particle comprised of 80 percent by weight of cobalt and coated with 20 percent by weight of copper metal:

Cobalt powder (Noah Chemical Corporation, 500 grams) is suspended in water (4 liters) containing a catalytic amount of icalulfuric acid (5 milliliters). To this suspension was then added slowly copper(II)sulfate (200 grams) over a five minute period. The solution resulting was stirred for 1 hour, wherein the iron powder surface was oxidized to iron sulfate (soluble in water), and the copper(II)sulfate was reduced onto the seed iron powder metal to copper. The resultant reddish-brown product was then filtered by vacuum filtration and washed with water, and then air dried to yield the reddish magnetic material product (485 grams) comprised of cobalt core of about 80 percent by weight, and a lightly colored copper coating of about 20 percent by weight. The resulting reddish-brown magnetic particles had a volume average particle diameter of 1.8 microns and a particle size distribution of 1.26 as determined by Coulter Counter measurements using Coulter Counter Model ZM, available from Coulter Electronics, Inc.

The saturation magnetic moment was then obtained by referencing its induced current per gram by using 10 grams of sample to that of a 10 gram sample of nickel. For the magnetic particles of this Example, the saturation magnetic moment was 80 emu per gram. The conductivity was obtained by preparing a pressed pellet at 2,000 pounds per square inch, and employing a standard conductivity meter device. For the magnetic particles of this Example, the conductivity was measured to be $3\times10^{-5}$ (ohm-cm)$^{-1}$. The red color of this magnetic material stable was even after 12 months of storage at room temperature. The product color properties were then measured using the Match-Scan II spectrometer available from Vidan Corporation, and for the magnetic particles of this Example the lightness value was 28 units, the chroma was 9 units and the hue was 21 units.

EXAMPLE IV

Synthesis of a reddish conductive magnetic particle comprised of 80 percent by weight of iron and coated with 10 percent by weight of copper metal and overcoated with 10 percent by weight of copper iodide:

Iron powder (SICOPUR 4068FF TM, 500 grams) was suspended in water (4 liters) containing a catalytic amount of sulfuric acid (5 milliliters). To this suspension was then added slowly copper(II)sulfate (200 grams) over a five minute period. The solution resulting was stirred for 1 hour, wherein the iron powder surface was oxidized to iron sulfate (soluble in water) and the copper(II)sulfate was reduced onto the seed iron powder metal to copper. The resultant reddish product was then filtered off, washed with water and resuspended in 1 liter of water and 1 liter of methanol. To this suspension was then added 50 grams of iodine and stirring continued for a period of two hours, after which an aqueous solution of 5 percent by weight of sodium thiosulfate was added until the excess iodine was destroyed, followed by filtration, washing with water, and then air dried to yield a lightly red colored magnetic material (490 grams) comprised of iron core of about 80 percent by weight, a lightly colored copper coating of about 10 percent by weight, and a colorless overcoating comprised of copper iodide of about 10 percent by weight. The resulting reddish magnetic particles had a volume average particle diameter of 3.8 microns and a particle size distribution of 1.36 as determined by Coulter Counter measurements using Coulter Counter Model ZM, available from Coulter Electronics, Inc.

The saturation magnetic moment was then obtained by referencing its induced current per gram by using 10 grams of sample product to that of a 10 gram sample of nickel. For the magnetic particles of this Example, the saturation magnetic moment was 82 emu per gram. The conductivity was obtained by preparing a pressed pellet of the product at 2,000 pounds per square inch, and employing a standard conductivity meter device. For the magnetic particles of this Example, the conductivity was measured to be $2\times10^{-2}$ (ohm-cm)$^{-1}$. The red color of this magnetic material was stable even after 12 months of storage at room temperature. The color properties were then measured using the Match-Scan II spectrometer available from Vidan Corporation, and for the magnetic particles of this Example the lightness value was 12 units, the chroma was 2 units and the hue was 8 units.

EXAMPLE V

Synthesis of a reddish conductive magnetic particle comprised of 80 percent by weight of iron and coated with 5 percent by weight of copper metal and overcoated with 15 percent by weight of copper iodide:

Iron powder (SICOPUR 4068FF TM, 500 grams) is suspended in water (4 liters) containing a catalytic amount of sulfuric acid (5 milliliters). To this suspension is then added slowly copper(II)sulfate (200 grams) over a five minute period. The solution is stirred for 1 hour, wherein the iron powder surface is oxidized to iron sulfate (soluble in water) and the copper(II)sulfate is reduced onto the seed iron powder metal to copper. The resultant reddish product is then filtered off, washed with water and resuspended in 1 liter of water and 1 liter of methanol. To this suspension is then added 75 grams of iodine and strirring continued for a period of two hours, after which an aqueous solution of 5 percent by weight of sodium thiosulfate is added until the excess iodine is destroyed, followed by filtration, washed with water and then air dried to yield a lightly red colored magnetic material (490 grams) comprised of iron core of about 80 percent by weight, a lightly colored copper coating of about 5 percent by weight, and a colorless overcoating comprised of copper iodide of about 15 percent by weight. The resulting reddish magnetic particles had a volume average particle diameter of 3.6 microns and a particle size distribution of 1.32 as determined by Coulter Counter measurements using Coulter Counter Model ZM, available from Coulter Electronics, Inc.

The saturation magnetic moment was then obtained by referencing its induced current per gram by using 10 grams of sample product to that of a 10 gram sample of nickel. For the magnetic particles of this Example, the saturation magnetic moment was 91 emu per gram. The conductivity was obtained by preparing a pressed pellet, 25 grams of product, at 2,000 pounds per square inch, and employing a standard conductivity meter device. For the magnetic particles of this Example, the conductivity was measured to be $3\times10^{-3}$ (ohm-cm)$^{-1}$. The red color of this magnetic material was stable even after 12 months of storage at room temperature. The color properties were then measured using the Match-Scan II spectrometer available from Vidan Corporation, and for the magnetic particles of this Example the lightness value was 18 units, the chroma was 12 units and the hue was 21 units.

EXAMPLE VI

Synthesis of a reddish conductive magnetic particle comprised of 80 percent by weight of cobalt and coated with 10 percent by weight of copper metal and overcoated with 10 percent by weight of copper iodide:

Cobalt powder (500 grams) is suspended in water (4 liters) containing a catalytic amount of sulfuric acid (5 milliliters). To this suspension is then added slowly copper(II)sulfate (100 grams) over a five minute period. The solution is stirred for 1 hour, wherein the iron powder surface is oxidized to iron sulfate (soluble in water) and the copper(II)sulfate is reduced onto the seed iron powder metal to copper The resultant reddish product is then filtered off, washed with water and resuspended in 1 liter of water and 1 liter of methanol. To this suspension is then added 50 grams of iodine and stirring continued for a period of two hours, after which an aqueous solution of 5 percent by weight of sodium thiosulfate is added until the excess iodine is destroyed, followed by filtration, washed with water and then air dried to yield the above lightly red colored magnetic material (490 grams) comprised of cobalt core of about 80 percent by weight, a lightly colored copper coating of about 10 percent by weight, and a colorless overcoating comprised of copper iodide of about 10 percent by weight. The resulting reddish-brown magnetic particles had a volume average particle diameter of 1.9 microns and a particle size distribution of 1.28 as determined by Coulter Counter measurements using Coulter Counter Model ZM, available from Coulter Electronics, Inc.

The saturation magnetic moment was then obtained by referencing its induced current per gram; 10 grams of sample product to that of a 10 gram sample of nickel. For the magnetic particles of this Example, the saturation magnetic moment was 82 emu per gram. The conductivity was obtained by preparing a pressed pellet, 50 grams of proudct sample, at 2,000 pounds per square inch, and employing a standard conductivity meter device. For the magnetic particles of this Example, the conductivity was measured to be $2\times10^{-3}$ (ohm-cm)$^{-1}$. The red color of this magnetic material was stable even after 12 months of storage at room temperature. The color properties were then measured using the Match-Scan II spectrometer available from Vidan Corporation, and for the magnetic particles of this Example the lightness value was 19 units, the chroma was 7 units and the hue was 18 units.

EXAMPLE VII

Synthesis of a conductive colored toner composition containing the magnetic particles of Example I A mixture of 108.0 grams of POLYWAX 2,000 TM (polyethylene oxide available from Petrolite Corporation), 24.0 grams of ELVAX 420 TM (polyalkylene oxide available from E. I. DuPont), 24.0 grams of VERSAMID 744 TM (a polyamide available from Henkle Inc.), 168.0 grams of iron-copper powder (Example I), and 28.0 grams of LITHOL SCARLET TM pigment was mixed and ground in a Fitzmill Model J equipped with a 850 micrometer screen. After grinding, the mixture was dry blended first on a paint shaker and then on a roll mill. A small counter-rotating twin screw extruder (DAVO TM) was then used to melt mix the aforementioned mixture. A K-Tron twin screw volumetric feeder was employed in feeding the mixture to the extruder which had a barrel temperature of 150° C. (flat temperature profile), and a screw rotational speed of 60 rpm with a feed rate of 10 grams per minute. The extruded strands were broken down into coarse particles by passing them through a Model J Fitzmill twice, first with an 850 micrometer screen, and then with a 425 micrometer screen. The coarse particles thus produced were micronized using an 8 inch Sturtevant micronizer and classified in a Donaldson classifier. The resulting red toner had a volume average particle diameter of 19.1 microns and a particle size distribution of 1.31 as determined by Coulter Counter measurements using Coulter Counter Model ZM, available from Coulter Electronics, Inc.

The toner's saturation magnetic moment was then obtained by referencing its induced current per gram, 3 grams to that of a 10 gram sample of nickel. For the toner of this Example, the saturation magnetic moment was 46.0 emu per gram. The toner's conductivity was measured by preparing a pressed pellet of the toner at 2,000 pounds per square inch and using a conductivity meter unit. The conductivity of the toner of this example was $8.8\times10^{-6}$ (ohm-cm)$^{-1}$.

The above prepared toner was evaluated in a Xerox Corporation 4060 TM printer. The toned images were transfixed onto paper with a transfix pressure of 4,000 psi. Print quality was evaluated from a checkerboard print pattern. The image optical density was measured with a standard integrating densitometer. Image fix was measured by the standardized scotch tape pull method, and was expressed as a percentage of the retained image optical density after the tape test relative to the original image optical density. Image smearing was evaluated qualitatively by hand rubbing the fused checkerboard print using a blank paper under an applied hand force, and viewing the surface cleanliness of unprinted and printed areas of the page. Image ghosting on paper was evaluated visually. For the above prepared toner, the image fix level was 71 percent, and no image smear and no image ghosting were observed in this machine testing for 2,000 prints. The color properties of a print were then measured using the Match-Scan II spectrometer, and for the toner image of this example, the lightness was 55 units, the chroma was 71 units and the hue was 68 units.

EXAMPLE VIII

Synthesis of a conductive colored toner composition containing the magnetic particles of Example IV A mixture of 108.0 grams of POLYWAX 2,000 TM (polyethylene oxide available from Petrolite Corporation), 24.0 grams of ELVAX 420 TM (polyalkylene oxide available from E. I. DuPont), 24.0 grams of VERSAMID 744 TM (a polyamide available from Henkle Inc.), 168.0 grams of iron-copper-copper iodide powder (Example IV), and 28.0 grams of LITHOL SCARLET TM pigment was mixed and ground in a Fitzmill Model J equipped with an 850 micrometer screen. After grinding, the mixture was dry blended first on a paint shaker and then on a roll mill. A small counter-rotating twin screw extruder (DAVO TM) was then used to melt mix the aforementioned mixture. A K-Tron twin screw volumetric feeder was employed in feeding the mixture to the extruder which had a barrel temperature of 150° C. (flat temperature profile), and a screw rotational speed of 60 rpm with a feed rate of 10 grams per minute. The extruded strands were broken down into coarse particles by passing them through a Model J Fitzmill twice, first with an 850 micrometer screen, and then with a 425 micrometer screen. The coarse particles thus produced were micronized using an 8 inch Sturtevant micronizer and classified in a Donaldson classifier. The resulting red toner had a volume average particle diameter of 21 microns and a particle size distribution of 1.34 as determined by Coulter Counter measurements using Coulter Counter Model ZM, available from Coulter Electronics, Inc.

The toner's saturation magnetic moment was then obtained by referencing its induced current per gram, 3 grams of toner sample to that of a 10 gram sample of nickel. For the toner of this Example, the saturation magnetic moment was 48.0 emu per gram. The toners conductivity was measured by preparing a pressed pellet of the toner at 2,000 pounds per square inch and using a conductivity meter unit. The conductivity of the toner of this example was $5\times10^{-4}$ (ohm-cm)$^{-1}$.

The above prepared toner was evaluated in a Xerox Corporation 4060 TM printer. The toned images were transfixed onto paper with a transfix pressure of 4,000 psi. Print quality was evaluated from a checkerboard print pattern. The image optical density was measured with a standard integrating densitometer. Image fix was measured by the standardized scotch tape pull method, and was expressed as a percentage of the retained image optical density after the tape test relative to the original image optical density. Image smearing was evaluated qualitatively by hand rubbing the fused checkerboard print using a blank paper under an applied hand force, and viewing the surface cleanliness of unprinted and printed areas of the page. Image ghosting on paper was evaluated visually. For the above prepared toner, the image fix level was 74 percent, and no image smear and no image ghosting were observed in this machine testing for at least 2,000 prints. The color properties of a print were then measured using the Match-Scan II spectrometer, and for the toner of this example, the lightness was 54 units, the chroma was 82 units and the hue was 76 units.

EXAMPLE IX
(COMPARATIVE)

Synthesis of a colored toner composition containing a magnetic material such as iron with no coating A mixture of 108.0 grams of POLYWAX 2,000 TM (polyethylene oxide available from Petrolite Corporation), 24.0 grams of ELVAX 420 TM (polyalkylene oxide available from E. I. DuPont), 24.0 grams of VERSAMID 744 TM (polyamide available from Henkle Inc.), 168.0 grams of iron powder (available from BASF as SICOPUR 4688 TM), and 28.0 grams of LITHOL SCARLET TM pigment was mixed and ground in a Fitzmill Model J equipped with an 850 micrometer screen. After grinding, the mixture was dry blended first on a paint shaker and then on a roll mill. A small counter-rotating twin screw extruder (DAVO TM) was then used to melt mix the aforementioned mixture. A K-Tron twin screw volumetric feeder was employed in feeding the mixture to the extruder which had a barrel temperature of 150° C. (flat temperature profile), and a screw rotational speed of 60 rpm with a feed rate of 10 grams per minute. The extruded strands were broken down into coarse particles by passing them through a Model J Fitzmill twice, first with an 850 micrometer screen, and then with a 425 micrometer screen. The coarse particles thus produced were micronized using an 8 inch Sturtevant micronizer and classified in a Donaldson classifier. The resulting dull brownish toner had a volume average particle diameter of 21 microns and a particle size distribution of 1.34 as determined by Coulter Counter measurements using Coulter Counter Model ZM, available from Coulter Electronics, Inc.

The toner's (3 grams of sample) saturation magnetic moment was then obtained by referencing its induced current per gram to that of a 10 gram sample of nickel. For the toner of this Example, the saturation magnetic moment was 48.0 emu per gram. The toner's conductivity was measured by preparing a pressed pellet of the toner at 2,000 pounds per square inch and using a conductivity meter unit. The conductivity of the toner of this Example was $1.5\times10^{-16}$ (ohm-cm)$^{-1}$.

The above prepared toner was evaluated in a Xerox Corporation 4060 TM printer. However, due to poor conductivity of the toner, images could not be developed.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of resin particles, pigment, and a colored highly conductive magnetic composition comprised of a core comprised of a metal, and thereover a coating comprised of a lightly colored metal selected from the group consisting of copper, silver, cobalt, tin, gold, manganese, titanium, magnesium, vanadium, chromium, zinc, cadmium, indium, rhodium, nobium, platinum and aluminum, and in contact with the lightly colored metal a top coating comprised of a substantially colorless metal halide.

2. A toner composition in accordance with claim 1 wherein the resin particles are selected from the group consisting of polyesters, styrene butadiene copolymers, styrene acrylate copolymers, styrene methacrylate copolymers, polyethylene oxide, polyalkylene oxide, polyamides, and mixtures thereof.

3. A toner composition in accordance with claim 2 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

4. A toner composition in accordance with claim 2 wherein the styrene butadiene copolymer contains 91 percent by weight of styrene, and 9 percent by weight of butadiene.

5. A toner composition in accordance with claim 2 wherein there is selected a suspension polymerized styrene butadiene.

6. A toner composition in accordance with claim 2 further including therein a charge enhancing additive.

7. A toner composition in accordance with claim 6 wherein the charge enhancing additive is selected from the group consisting of distearyl dimethyl ammonium methyl sulfate, cetyl pyridinium halides, and stearyl phenethyl dimethyl ammonium tosylate.

8. A toner composition in accordance with claim 6 wherein the resin particles are comprised of a styrene butadiene copolymer containing 91 percent by weight of styrene and 9 percent by weight of a butadiene; or 87 percent by weight of styrene and 13 percent by weight of butadiene.

9. A developer composition comprised of the toner composition of claim 1, and carrier particles.

10. A developer composition in accordance with claim 9 wherein the carrier particles are comprised of a core with a polymeric coating thereover.

11. A developer composition in accordance with claim 9 wherein the carrier particles are comprised of a steel or a ferrite core with a coating thereover selected from the group consisting of polychlorotrifluoroethylene-co-vinylchloride copolymer, a polyvinylidene fluoropolymer, or a terpolymer of styrene, methacrylate, an organo silane, fluorinated ethylene-propylene copolymers, and polytetrafluoroethylene.

12. A toner composition in accordance with claim 1 wherein the metal comprises from about 50 to about 90 percent by weight of the magnetic composition.

13. A toner composition in accordance with claim 1 wherein the lightly colored metal comprises from about 0.1 to about 30 percent by weight of the magnetic composition.

14. A toner composition in accordance with claim 1 wherein the substantially colorless metal halide is copper chloride, copper bromide, copper iodide, magnesium iodide, cobalt iodide, silver iodide, vanadium chloride, chromium chloride, platinum chloride and comprises from about 0.1 to about 30 percent by weight of the magnetic composition.

15. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

16. A colored magnetic composition in accordance with claim 1 and wherein the core is present in an amount of from about 70 to about 90 percent by weight.

17. A composition in accordance with claim 16 wherein the core to be coated is metallic iron, cobalt, nickel, or mixtures thereof.

18. A composition in accordance with claim 1 wherein the lightly colored metal coating is metallic copper, tin, lead, silver, platinum, or mixtures thereof, and comprises from about 0.1 to about 30 percent by weight of the magnetic composition.

19. A composition in accordance with claim 1 wherein the metal halide overcoating is a halide of copper, tin, lead, silver, platinum, mercury or mixtures thereof, and comprises from about 0.1 to about 30 percent by weight of the magnetic composition.

20. A process for the preparation of colored conductive magnetic particles which comprises dispersing magnetic metal particles of iron, cobalt, or nickel in a solvent of water, and aliphatic alcohol containing a soluble metal salt of copper sulfate, silver nitrate or tin sulfate; wherein the electrochemical reduction potential of the soluble metal salt is more positive, form about $10^{-2}$ volts to about 10 volts, than the electrochemical reduction potential of the metal particle of iron, nickel, or cobalt to be coated; and wherein an electrochemical oxidation-reduction reaction occurs at the particle surface, wherein the core metal particle of iron, cobalt or nickle surface is oxidized to iron sulfate, cobalt nitrate or nickel sulfate, and dissolved in the solvent concurrently with the metal salt being reduced is a lightly colored metal coating of copper, silver or tin metal on the magnetic core of iron, cobalt or nickel surface.

21. A process in accordance with claim 20 wherein the metal particle to be coated is metallic iron, cobalt, nickel, or mixtures thereof and comprises from about 50 to about 90 percent by weight of the magnetic particle.

22. A process in accordance with claim 20 wherein the salt of the metal halide is fluorine, chlorine, bromine, iodine or mixture thereof.

23. A process in accordance with claim 20 wherein the solvent is water, methanol, or ethanol.

24. A process in accordance with claim 20 wherein the soluble metal salt contains the metal ion $Sn^{+2}$, $Pb^{+2}$ $Sn^{+4}$, $Cu_2Cl_3$, $Ag^+$, $Pt^{+2}$ or $Au^+$, or $Hg_2Cl_2$.

25. A process in accordance with claim 20 wherein the metal particle to be coated is iron and the soluble metal salt contains $Cu^+$.

26. A process in accordance with claim 20 wherein the soluble copper salt has a fluoride, chloride, bromide, iodide, acetate, cyanide, or thiocyanate counterion.

27. A process in accordance with claim 20 wherein an acid is added to the solution as a catalyst.

28. A process in accordance with claim 27 wherein the acid is hydrofluoric acid, hydrochloric acid, hydrobromic acid, hydroiodic acid, sulfuric acid, nitric acid, or acetic acid.

29. A process in accordance with claim 20 wherein an additional soluble salt is added as a catalyst.

30. A process in accordance with claim 29 wherein the additional soluble salt contains fluoride, chloride, bromide, iodide, acetate, sulfate, nitrate, or thiocyanate counterions.

31. Colored toner compositions comprised of a mixture of the colored magnetic particles of claim 16, a colored pigment component of cyan, yellow, magenta, red, green, blue, brown, or mixtures thereof, a resin binder, optional charge enhancing additives, and surface flow enhancing components.

32. A toner in accordance with claim 31 wherein the surface flow additives are comprised of conductive metal oxides, metal salts, metal salts of fatty acids, colloidal silicas, quaternary ammonium salts, sulfonamides, sulfonimides, metal complexes, organometallic complexes, or mixtures thereof.

33. A toner in accordance with claim 31 wherein the colored conductive magnetic particles average volume particle diameter is from about 0.5 micron to about 25 microns.

34. A toner in accordance with claim 31 wherein the colored magnetic particles magnetic saturation is from about 30 emu per gram to about 300 emu per gram.

35. A toner in accordance with claim 31 wherein the colored magnetic particles have a conductivity of from about $10^{-4}$ (ohm-cm)$^{-1}$ to about $10^{-8}$ (ohm-cm)$^{-1}$, a lightness of from about 0 to about 60 units, a chroma of from about 0 to about 40 units, and a hue of from about 0 to about 40 units.

36. A toner in accordance with claim 1 wherein the metal halide is selected from the group consisting of copper iodide, copper chloride, copper bromide, magnesium iodide, cobalt iodide, silver iodide, vanadium chloride, chromium chloride, and platinum chloride.

37. A toner in accordance with claim 1 wherein the pigment is cyan, magenta, yellow, red, blue, green, brown, or mixtures thereof.

* * * * *